US006808047B2

(12) United States Patent
Takeshima

(10) Patent No.: US 6,808,047 B2
(45) Date of Patent: Oct. 26, 2004

(54) ESCAPE DEVICE

(76) Inventor: Maki Takeshima, B-3 Green Pallet Higashi-Oizumi, 7-35-31, Higashi-Oizumi, Nerima-ku, Tokyo (JP)

( * ) Notice: Subject to any disclaimer, the term of this patent is extended or adjusted under 35 U.S.C. 154(b) by 0 days.

(21) Appl. No.: 10/227,273

(22) Filed: Aug. 26, 2002

(65) Prior Publication Data

US 2003/0085073 A1 May 8, 2003

(30) Foreign Application Priority Data

Nov. 5, 2001 (JP) ..... 2001-339148

(51) Int. Cl.[7] ..... A62B 1/06
(52) U.S. Cl. ..... 182/70; 182/73
(58) Field of Search ..... 182/82, 70–73, 182/3–7

(56) References Cited

U.S. PATENT DOCUMENTS 4,174,711 A 11/1979 Laing et al.
4,286,690 A 9/1981 Gastine
4,305,685 A * 12/1981 Rentfrow ..... 405/186
4,469,198 A 9/1984 Crump
4,709,783 A 12/1987 Tomioka et al.
5,445,114 A * 8/1995 Walker ..... 119/857
6,182,789 B1 2/2001 Okamura

FOREIGN PATENT DOCUMENTS

JP SHO 47-30998 12/1972
JP SHO 51-151499 12/1976

* cited by examiner

*Primary Examiner*—Alvin C. Chin-Shue
(74) *Attorney, Agent, or Firm*—Ronald R. Snider; Snider & Associates

(57) ABSTRACT

An escape device for allowing a person to escape from a high position to a predetermined landing point. The escape device basically includes: an elastic cord element elastically stretchable to a maximum length substantially at the landing point; a container element provided at the high position; and a carrier element connected with the elastic cord element. Accordingly, a person can descend via the carrier element from the high position and softly land on the landing point. A plurality of carrier elements may be provided and connected together via plural elastic cord elements and auxiliary ropes, using disengagement mechanism, to provide a multistage escape device, so that the carrier elements can be disengaged from one another in sequence when they are falling so as to permit person(s) to descend and softly land on a ground at the landing point.

11 Claims, 8 Drawing Sheets

ESCAPE DEVICE

RELATED APPLICATIONS

This application claims the priority of Japanese Patent Application No. 2001-339148, filed on Nov. 5, 2001, which is incorporated herein by reference.

FIELD OF THE INVENTION

The present invention relates to an escape device which enables a person(s) to escape or descend from a high position such as a building and especially from a high-rise building which makes it difficult to rescue or evacuate people even by aerial ladder trucks or helicopters.

BACKGROUND OF THE INVENTION

A horrible terrorism disaster in the U.S.A., widely known as the crashes of hijacked airplanes into skyscrapers on Sep. 11, 2001, has remained in the minds of many people. The skyscrapers were entirely destroyed, injuring and killing a great number of peoples, which was reportedly mainly due to a fire occurred in the buildings.

In the case of a low-rise building, an aerial ladder truck or ladder-type fire engines can be utilized to rescue the building occupants therefrom. On the other hand, with regard to a mid-rise building or a high-rise building, it is necessary to use a helicopter for the rescue actions.

However, with an increased number of gigantic high-rise buildings or skyscrapers having recently prevailed in many parts of countries world-widely, there is an increasingly high possibility for strong winds to be blown among those extraordinary tall buildings, which may prevent access of rescue helicopters to a target points in the buildings and result in unsuccessful rescue activities. Moreover, when a fire occurs in the high-rise buildings, most of the building occupants will be exposed to a high heat and smokes and attempt to get out from the windows. If they fall from the windows of such high-rise buildings, a fatal consequence will inevitably result and there would be no assurance to their lives. Even when a fire occurs in a low-rise building, it is possible that the roads and streets around the building are intricate and narrow, in which case, any aerial ladder truck or ladder-type fire engine can hardly run through the roads and streets to reach the building, thus making it difficult to rescue the building occupants therefrom.

SUMMARY OF THE INVENTION

In view of the above-stated drawbacks, it is a purpose of the present invention to provide an escape device which permits at least one person to escape or descend from a high position to a low position under an emergency condition where a fire occurs.

In order to achieve such purpose, the escape device in accordance with the present invention is basically comprised of:

- an elastic cord means having a length and an property of being stretchable from the length to a maximum length substantially at a predetermined landing point, said elastic cord means having a free end;
- a container means so designed that the elastic cord means is supportively stored while being allowed to be pulled out therefrom, the container means being provided at a high position; and
- a carrier means connected with the free end of the elastic cord means, the carrier means being so designed to permit the at least one person to hold the carrier means or secure his or her body thereto and descended therewith via the elastic cord means from the high position to the predetermined landing point.

In one aspect of the invention, the carrier means may comprise a bar element capable of being grasped and held by hands of the person.

In another aspect of the invention, the carrier means may comprise a backpack-type carrier unit having a shoulder strap means, and there may be provided an auxiliary rope means which is supportively stored in the container means while being allowed to be pulled out therefrom, while the carrier means be releasably connected with the free end of the elastic cord means. Also, there may be provided a disengagement means which is connected with the free end of auxiliary rope means, the disengagement means being workable to disengage the free end of elastic cord means from the carrier means when the carrier means reaches the predetermined landing point while at the same time the auxiliary cord means is pulled out and extended to the whole length thereof.

In still another aspect of the invention, as the carrier means, a first carrier means and a second carrier means may be provided, using the auxiliary rope means and the disengagement means, with such an arrangement that the first and second carrier means may be disengaged from each other via the elastic cord means, auxiliary rope means and disengagement means when they are descended from the high position to the predetermined landing point. In such case, the second carrier means may comprise a backpack-type carrier unit having a shoulder strap means, In yet still another aspect of the invention, a gondola may be provided on the foregoing first and second carrier means so as to accommodate at least two persons therein, in place of the backpack-type carrier unit.

The above and other purposes, features and advantages of the present invention will become apparent from the following detailed description taken with the accompanying drawings.

DETAILED DESCRIPTION

Figure 1:
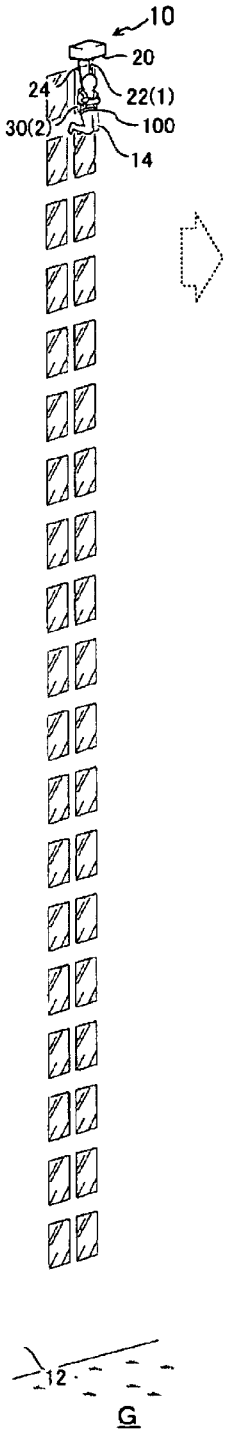
FIGS. 1(A) to 1(D) are diagrams of a first embodiment of escape device in accordance with the present invention, which explanatorily show how it is disposed and used for escape purpose.
Figure 1:
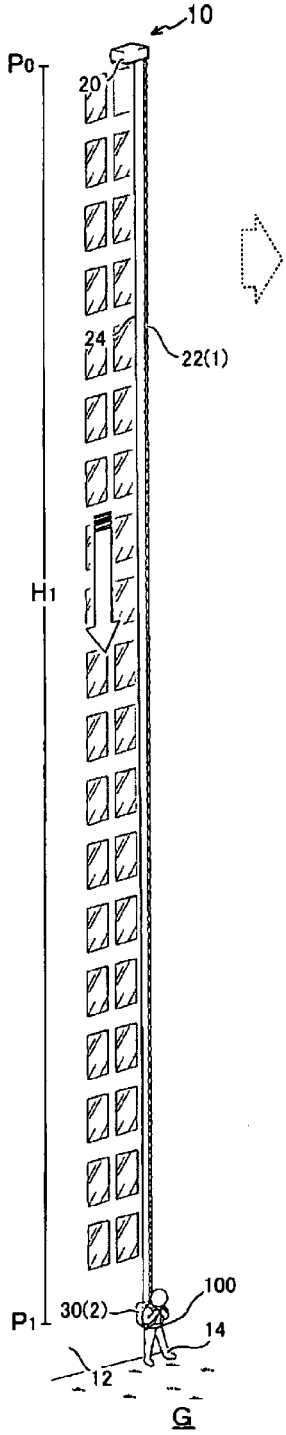
Figure 1:
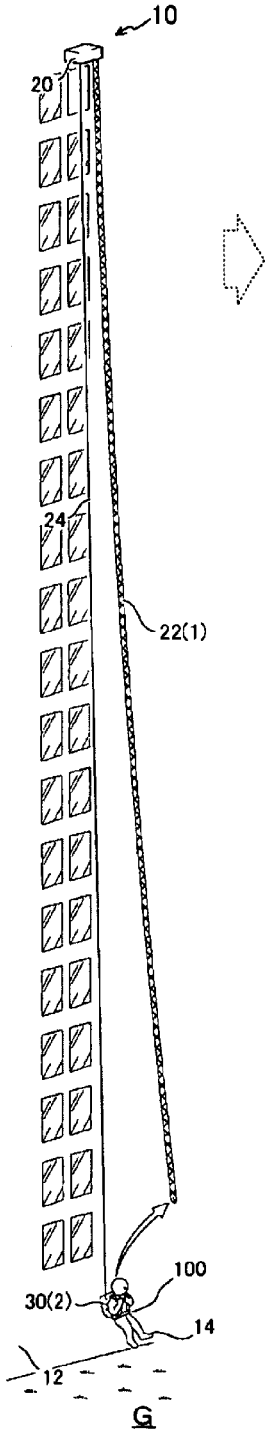
Figure 1:
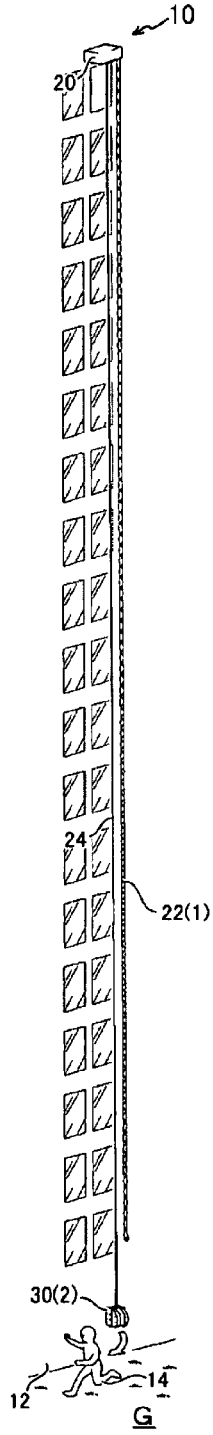

Referring now to FIGS. 1 through 8(B), there are illustrated preferred embodiments of the present invention. But, generically stated, in accordance with the present invention, an escape device, as generally designated by 10, is commonly comprised of an elastic cord means or a bungee cord means as indicated by the parenthetic designation (1) and a carrier means indicated by the parenthetic designation (2) in the drawings. According to a basic principle of the present invention, the bungee cord means (1) is fixed at its base end to a high position and connected at its free end with the carrier means (2) (or a descending means), so that the carrier means (2) is displaceable resiliently via the bungee cord means (1) from the high position down to a low rescue designation or land, thereby helping to transfer person(s) to a safe location for rescue purpose. It should be understood that the embodiments to be described hereinafter are just exemplary embodiments and indicative of various modes of the bungee cord means (1) and carrier means (2) possible within the gist and scopes of the present invention. They are therefore not limitative. At first, the escape device 10 of the present invention is based on an elastic yet rigid property of a known bungee cord (at (1))(typically formed from a rubber material or other suitable elastic material) which is used in the so-called bungee jump, wherein the bungee cord tends to reduce the acceleration of descending velocity at which a person is fallen downwardly under the influence of gravity, and elastically draw the person upwardly against the gravity.

Now, specific description will be made of each of the following exemplary embodiments of the present invention.

Embodiment 1

Reference is made to FIGS. 1(A) to 1(D), FIGS. 2(A) and 2(B), and FIGS. 3(A) and 3(B) which show a first exemplary mode of the escape device 10. In the present embodiment, the illustrated escape device 10 is comprised of: one rubber rope 22 as the foregoing elastic or bungee cord means (1); a backpack-type carrier unit 30 as the foregoing carrier means (2); an auxiliary rope (or wire) 24; and a support container unit 20 for supportively accommodating the rubber and auxiliary ropes 22, 24 therein. It is noted that this mode of escape device 10 is suited for a high-rise building 12.

Figure 2B:
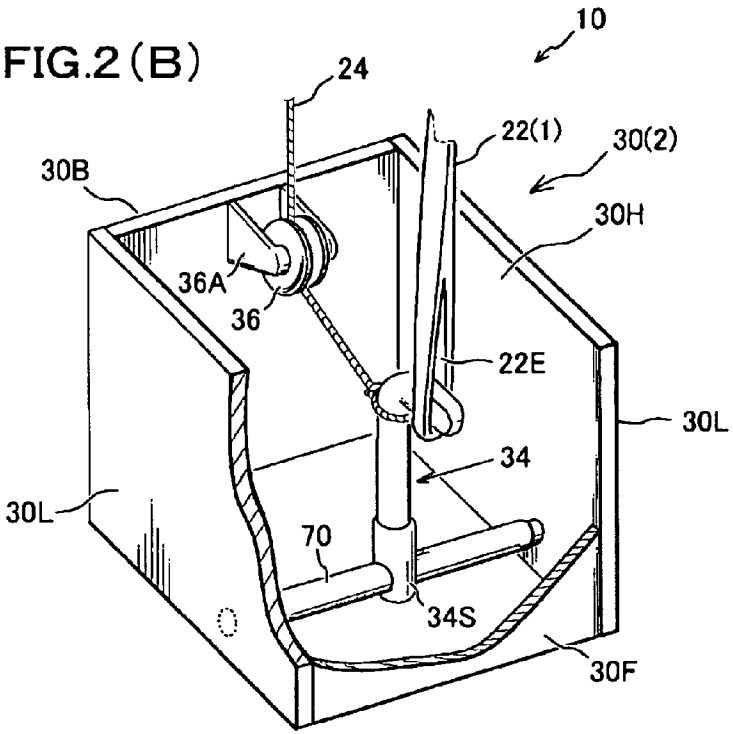
FIG. 2(B) is a partly broken schematic perspective view of the carrier unit shown in FIG. 2(A)
Figure 2A:
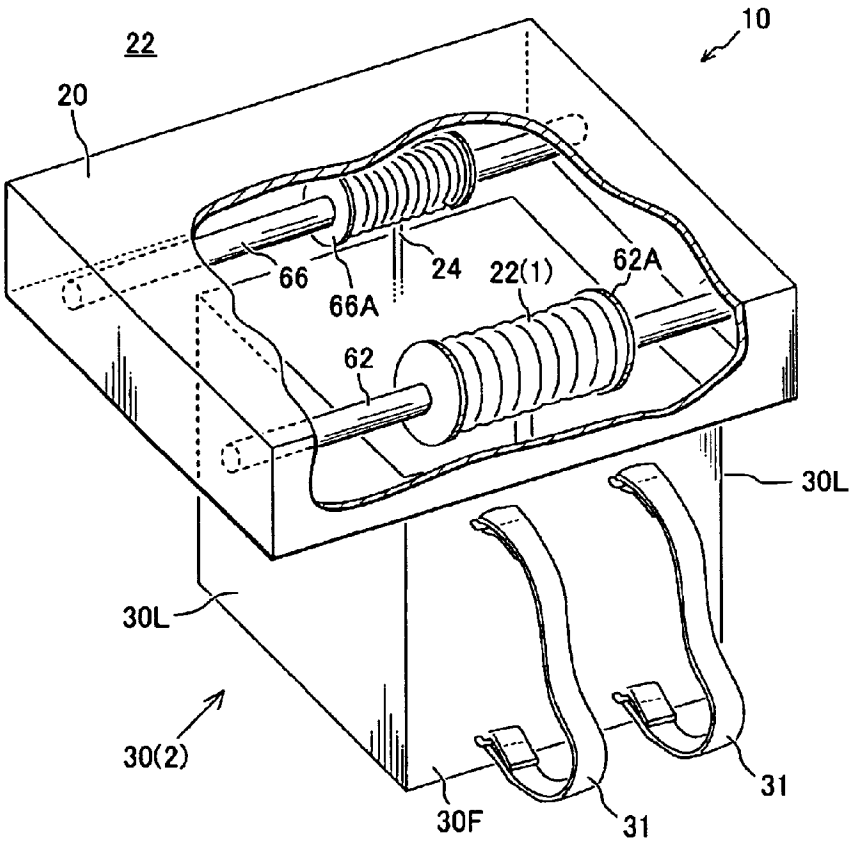
FIG. 2(A) is a partly broken schematic perspective view showing a support container unit and a carrier unit in accordance with the first exemplary embodiment of escape device.

As best shown in FIGS. 2(A) and 2(B), the backpack-type carrier unit 30 (descending unit) is of such a backpack configuration with a pair of shoulder straps 31, which allows a person to bear on his or her back. Specifically, this particular carrier unit 30 is formed in a cubic configuration having an upper opened side 30H, a pair of lateral walls 30L, a forward wall 30F and backward wall 30B. In that carrier unit 30, an inverted-L-shaped arm 34 is rotatably journalled via a support shaft 70 between the two lateral walls 30L as best seen from FIG. 2(B), and a pulley 36 is rotatably supported by a bracket 36A fixed on the backward wall 30B. The two shoulder straps 31 are fixed on the forward wall 30F.

Figure 3B:
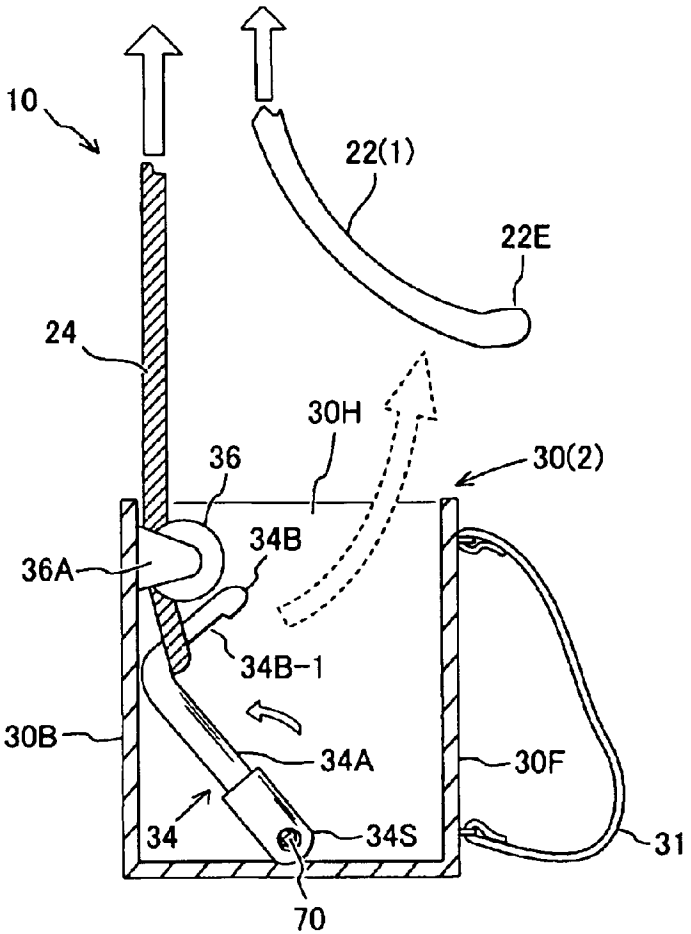
FIGS. 3(A) and 3(B) illustrate how a rubber rope is disengaged from the carrier unit.
Figure 3A:
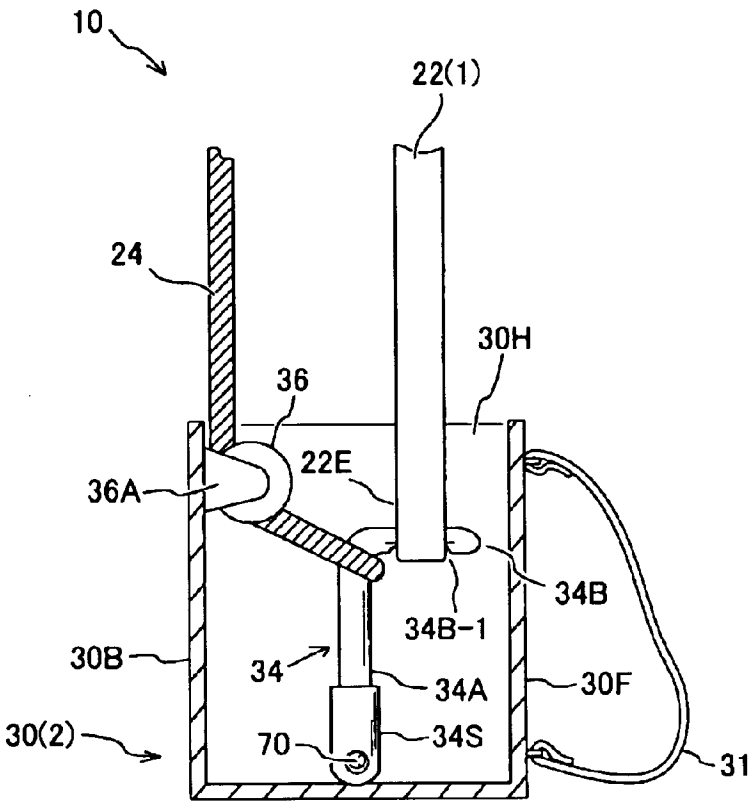

As shown in FIGS. 2(B), 3(A) and 3(B), the arm 34 has a vertical portion 34A and a horizontal portion 34B. The lower end of the vertical portion 34A is provided with a biasing mechanism 34S which is in turn rotatably coupled with the support shaft 70. Though not shown, the biasing mechanism 34A is a of a known structure including a spring or the like to biasingly cause the arm 34 to rotate about the shaft 70 toward the forward wall 30F of carrier unit 30. On the other hand, the horizontal portion 34B of the arm 34 is formed with a recession 34B-1 adapted to receive the looped end 22E of the rubber rope 22 therein in such a manner as to normally retain that end 22E against accidental removal therefrom, but allow easy release of the same therefrom when the arm 34 is inclined as will be described.

Referring to FIG. 2(A) in conjunction with FIG. 1(A), the support container unit 20 is fixedly attached to the wall of the high-rise building 12 at a point adjacent to or immediately above windows. Within the container unit 20, there are extended a first shaft 62 and a second shaft 66 in a rotatable manner. Fixed on the first shaft 62 is a first pulley 62A about which the rubber rope 22 is wound, with the looped end 22E thereof extending downwardly therefrom. Also, fixed on the second shaft 66 is a second pulley 66A about which the auxiliary rope 24 is wound, with a free remnant portion thereof extending downwardly therefrom.

As shown in FIG. 2(B), the downwardly and rectilinearly extending end portion of auxiliary rope 24 is engaged partway about the pulley 36 and bent therefrom toward the arm 34, terminating in an end which is firmly secured to the bent portion 34C of the arm 34. The looped end 22E of that rubber rope 22 is attached about the horizontal portion 34B of the arm 34, with the distal end of that looped end 22 being fit received in the recession 34B-1.

As indicated in FIG. 1(B), a workable length of the above-described rubber rope 22 is preset such that it will be resiliently stretchable to a maximum length with respect to a certain weight of a person 14 from a given high position P0 to a fixed landing point P1 where a person 14 (which will be referred to as "escaper 14" hereinafter) can touch his or her foot to the ground G. In the shown embodiment, the longest stretchable length of the rubber rope 22 generally corresponds to a height H1 between the high position P0 (where the support container unit 20 is provided) and the fixed landing point P1. On the other hand, the operative length of the auxiliary rope 24 is substantially equal to such height H1 so that the auxiliary rope 24 will run downwardly from the second pulley 66A in the support container unit 20 (or from the high position P0) to the extent that the rope 24 terminates such downward falling at the landing point P1 so as to draw the arm 34 against the biasing force of the biasing mechanism 34C. In other words, when the escaper 14, who falls downwardly with the carrier unit 30 on his or her back from the high position P0, lands on the ground G, the downward falling of auxiliary rope 24 is stopped to thereby draw and rotate that arm 34 in a direction to the backward wall 30B as seen from FIG. 3(B).

Both rubber rope 22 and auxiliary rope 24 are normally stored in the support container unit 20, as shown in FIG. 2(A). In this particular illustration, the carrier unit 30 is suspended from the support container unit 20 in a manner ready for use at any time. But, this is not imitative.

Now, an explanation will be made about how to use the present mode of escape device. When an escaper 14 in the building 12 attempts to escape therefrom, he or she has to bear the carrier unit 30 on his or her back, using the shoulder straps 31, and descend from the window of the building 12 as in FIG. 1(A). Then, both rubber and auxiliary ropes 22, 24 are drawn and run downwardly from their respective first and second pulleys 62A, 66A in the support container unit 20. While the escaper 14 is being fallen, the whole length of rubber rope 24 is rolled out and suspended from the first pulley 62A at a given point near to the landing point P1. Then, the rubber rope 24 is subjected to elastic further stretching and extension due to its elasticity, which effectively resists and reduces the accelerated velocity at which the escaper 14 is descending under the gravity. Consequently, the descending rate of the escaper 14 becomes smaller and smaller as the carrier unit 30 proceeds to the landing point P1.

Figure 4A:
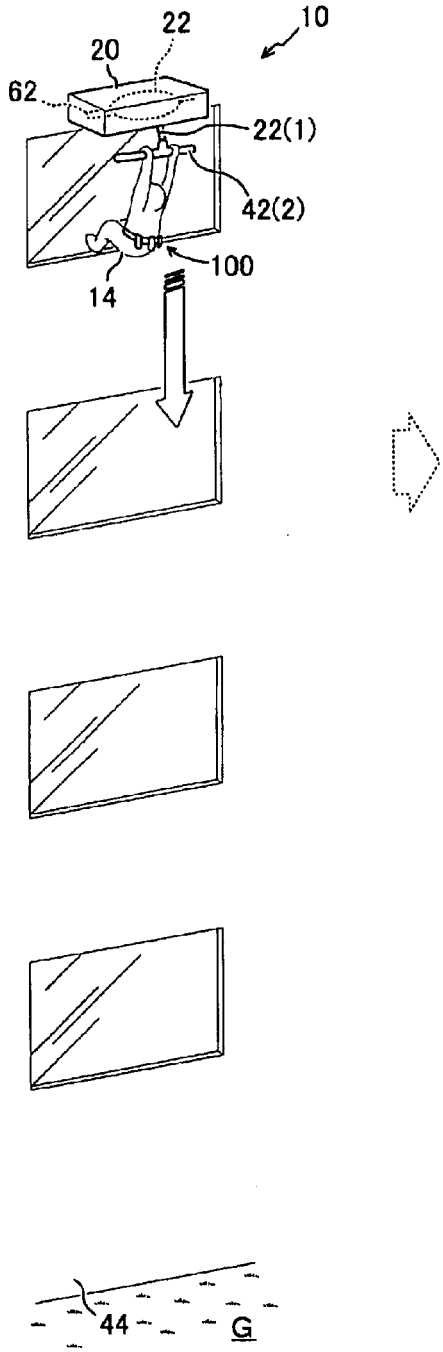
FIGS. 4(A) and 4(B) are diagrams of a second alternative embodiment of escape device, which explanatorily show how it is disposed and used for escape purpose.
Figure 5A:
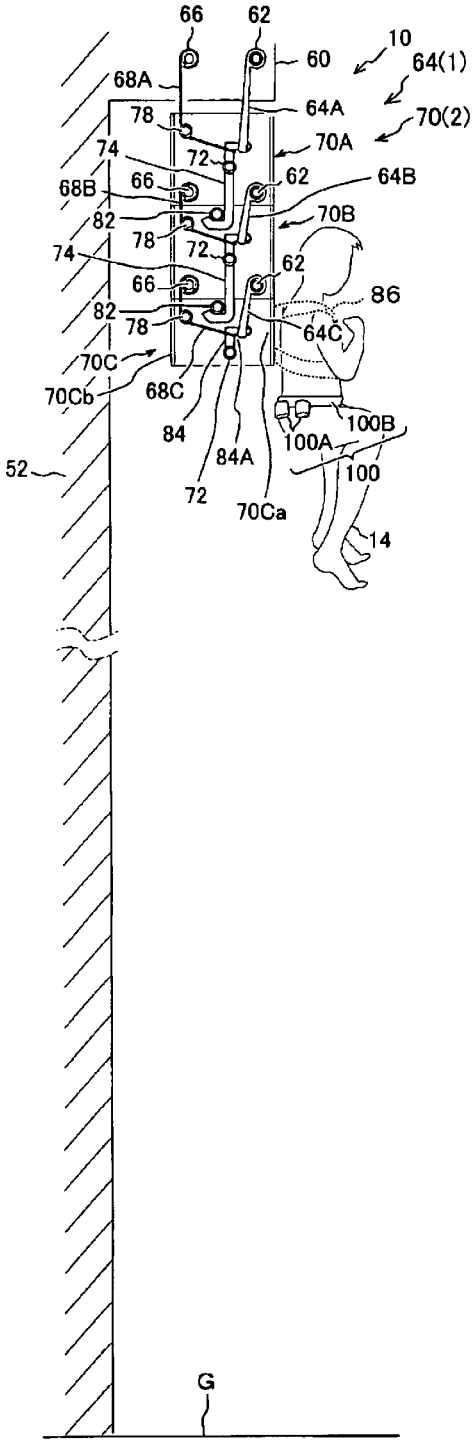
FIGS. 5(A) and 5(B) are diagrams of a third alternative embodiment of escape device, which explanatorily show how it is disposed and used for escape purpose.

Then, as shown in FIG. 1(B), when both carrier unit 30 and escaper 14 reach the landing point P1, the rubber rope 22 is resiliently stretched to a maximum degree, helping him or her to softly land on the ground G. Simultaneous therewith, at that landing point P1, the auxiliary rope 24 is extended to its preset whole length, with the result that, as understandable from the arrows in FIGS. 3(A) and 3(B), the downward end portion of the auxiliary rope 24 is pulled upwardly via the pulley 36, thereby rotating the arm 34 about the shaft 70, overcoming the biasing force of the biasing mechanism 34S, in a direction to the backward wall 30B of carrier unit 30. Then, as in FIG. 3(B), the arm 34 is inclined by such an angle that causes the arm horizontal portion 34B to displace from a horizontal position, at which the looped end 22E of rubber rope 22 is attached thereto, to an upwardly inclined position. As a result, that looped end 22E is quickly slid and disengaged from the thus-inclined arm horizontal portion 34B, as indicated by the phantom arrow in FIG. 3(B), whereupon the rubber rope 22 is disengaged from the carrier unit 30, thereby preventing the escaper 14 from being pulled back upwardly due to the elastic contraction of rubber rope 22. The escaper 14 can softly and positively land on the ground G, as in FIG. 1(C). Accordingly, referring to FIG. 1(D), the escaper 14 can take off the carrier unit 30 and leave from the building 12 to a safe place. It is noted that the escaper 14, who is relatively light in weight and insufficient to overcome an elastic pullback force of the rubber rope 22, may attach a weight belt 100 to his or her body so that both escaper 14 and carrier unit 30 can reach the landing point P1 without being pulled back upwardly before landing on the ground G. As shown in FIGS. 4(A) and 5(A) for instance, the weight belt 100 comprises a belt 100B and a plurality of weights 10A. While not clearly shown, all the weights 100A are detachably secured to the belt 100B, so that the escaper 14 may increase or reduce the number of the weights 100A according to his or her own weight with respect to the elastic pullback force of the rubber rope 22.

With the above-described mode of escape device 10, a quick rescue can be effected in the high-rise building 12 under conditions which make difficult an access of helicopter or ladder-type fire engine thereto in an emergency case involving a fire or the like. In particular, the escape device 10 will work effectively in such an imminent case where a ferocious fire in the high-rise building will force the building occupant(s) to have no other choice but to fall from the windows to possible death or serious injury.

Embodiment 2

Figure 4B:
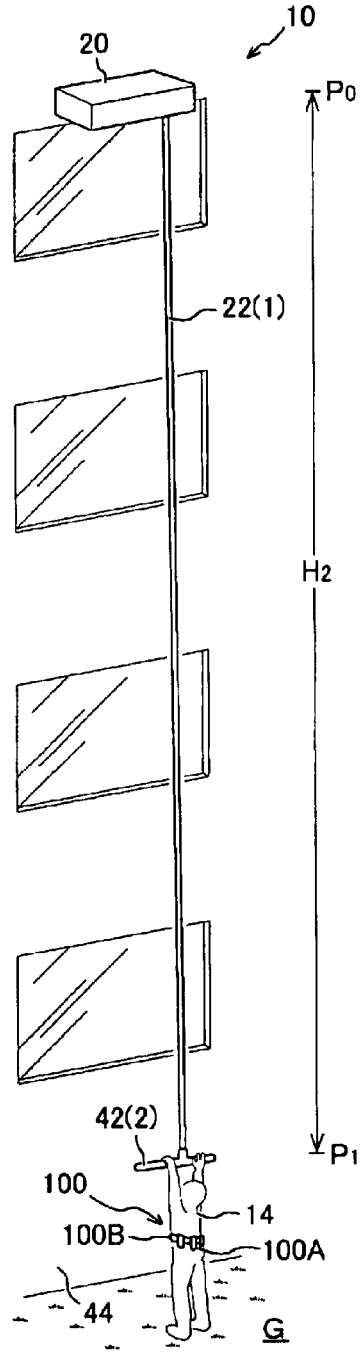

Referring to FIGS. 4(A) and 4(B), description will be made of a second alternative mode of the escape device 10. In the present embodiment, the illustrated escape device 10 is comprised of: one rubber rope 22 as the foregoing elastic or bungee cord means (1); a grab bar 42 as the foregoing carrier means (2); and a support container unit 20 for supportively accommodating the rubber ropes 22 therein, likewise as in the first embodiment. It is noted here that this mode of escape device 10 is suited for such low-rise building 44 as shown, and therefore, the rubber rope 22 used in this embodiment is small in length than the rubber rope 22 of the first embodiment.

The grab bar 42 is fixedly connected at its central portion with the lower end of the rubber rope 22, thus extending horizontally in a direction to intersect the vertically extending axis of the rubber rope 22.

As shown, the support container unit 20 is fixedly attached to the wall of the low-rise building 44 at a point adjacent to or immediately above windows. In this embodiment, as indicated by the phantom lines in FIG. 4(A), a shaft 62, as similar to the shaft 62 of the first embodiment, are rotatably provide within the support container unit 20. As understandable from FIG. 2(A), the rubber rope 22 is wound about the shaft 62, with the free end thereof fixed to the grab bar 42 being suspended downwardly therefrom.

As indicated in FIG. 4(B), a workable length of the rubber rope 22 is preset such that it will be resiliently stretchable to a maximum length with respect to a certain weight of a person 14 from a given high position P0 to a fixed landing point P1 where an escaper 14 can touch his or her foot to the ground G. In the shown embodiment, the longest stretchable length of the rubber rope 22 generally corresponds to a height H2 between the high point P0 (where the support container unit 20 is provided) and the fixed landing point P1. The rubber rope 22 is normally stored in the support container unit 20, as shown in FIG. 4(A), with the grab bar 42 being suspended from the support container unit 20 in a manner ready for use at any time. But, this is not imitative.

An explanation will be made about how to use the present second mode of escape device. When an escaper 14 in the building 44 attempts to escape therefrom, he or she has to hold the grab bar 42 with his or her hands and descend directly from the window of the building 44 as in FIG. 4(A). Then, the rubber ropes 22 is drawn and run downwardly from the shaft 62 in the support container unit 20. While the escaper 14 is being fallen, the whole length of rubber rope 22 is rolled out and suspended from the shaft 62 at a given point near to the landing point P1. Then, the rubber rope 22 is subjected to elastic further downward stretching and extension due to its elasticity, which effectively resists and reduces the accelerated velocity at which the escaper 14 is descending under the gravity. Consequently, the descending rate of the escaper 14 becomes smaller and smaller as the grab bar 42 proceeds to the landing point P1. Then, as shown in FIG. 4(B), when both grab bar 42 and escaper 14 reach the landing point P1, the rubber rope 22 is resiliently stretched to a maximum degree, helping him or her to softly land on the ground G. At this moment, the escaper 14 has to quickly release the grab bar 42 from his or her hands and leave from the building 44 to a safe place. As similar to the first embodiment, the escaper 14 may attach the weight belt 100 to his or her body so that both escaper 14 and grab bar 42 can reach the landing point P1 without being pulled back upwardly before landing on the ground G. The weight belt 100 comprises the belt 100A and a plurality of weights 100B. While not clearly shown, all the weights 100B are detachably secured to the belt 10A, so that the escaper 14 may increase or reduce the number of the weights 100B according to his or her own weight with respect to the elastic pullback force of the rubber rope 22.

Embodiment 3

With further reference to FIGS. 5(A) to 7, there are illustrated an exemplary third mode of the escape device 10 which is of a multistage type comprising a plurality of carrier units 70. This is designed for allowing an escaper 14 to be escaped in a comfortable and safe manner from such an extremely high position as a mid-rise or high-rise building or a skyscraper, in contrast to the above-described first and second embodiments wherein the escaper 14 will descend to a landing point with one fling, using one elastic cord means (1) and one carrier means (2). In other words, in the case of the mid- or high-rise building or skyscraper, the higher is the descending start point (at P0), the more increasingly becomes the acceleration of a descending velocity of the escaper 14 who falls from that point, which is proportional to the weight of the escaper 14. It therefore follows that, even if one auxiliary rope (at 24 in FIG. 2(A)) and one carrier unit (at (2)) are used with a preset landing point (P1) as in the second embodiment, the escaper 14 will experience a great shock and a damage in his or her body when the carrier unit (2) is stopped abruptly when the auxiliary rope (24) terminates its falling to the whole length thereof from the support container unit (20) at that landing point (P1).

Figure 5B:
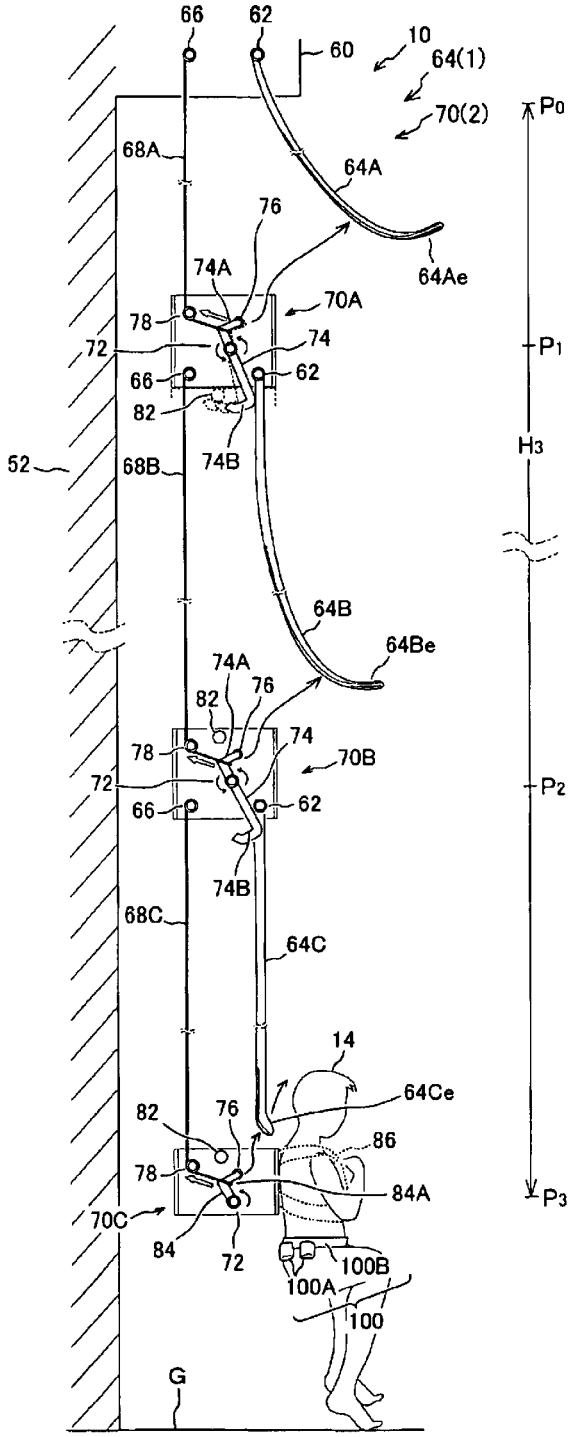
Figure 6:
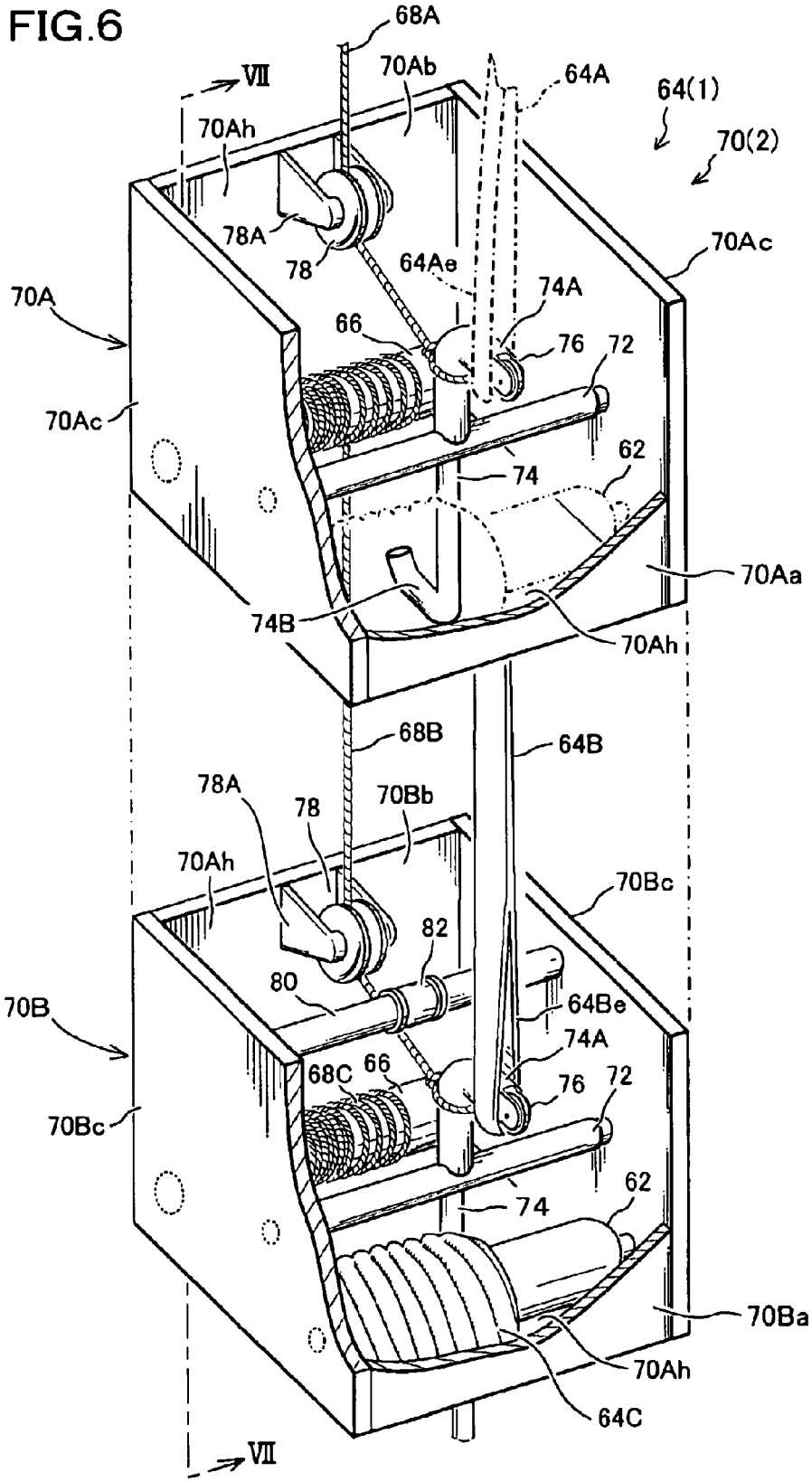
FIG. 6 is a partly broken schematic perspective view showing first and second carrier units of the third embodiment.
Figure 7:
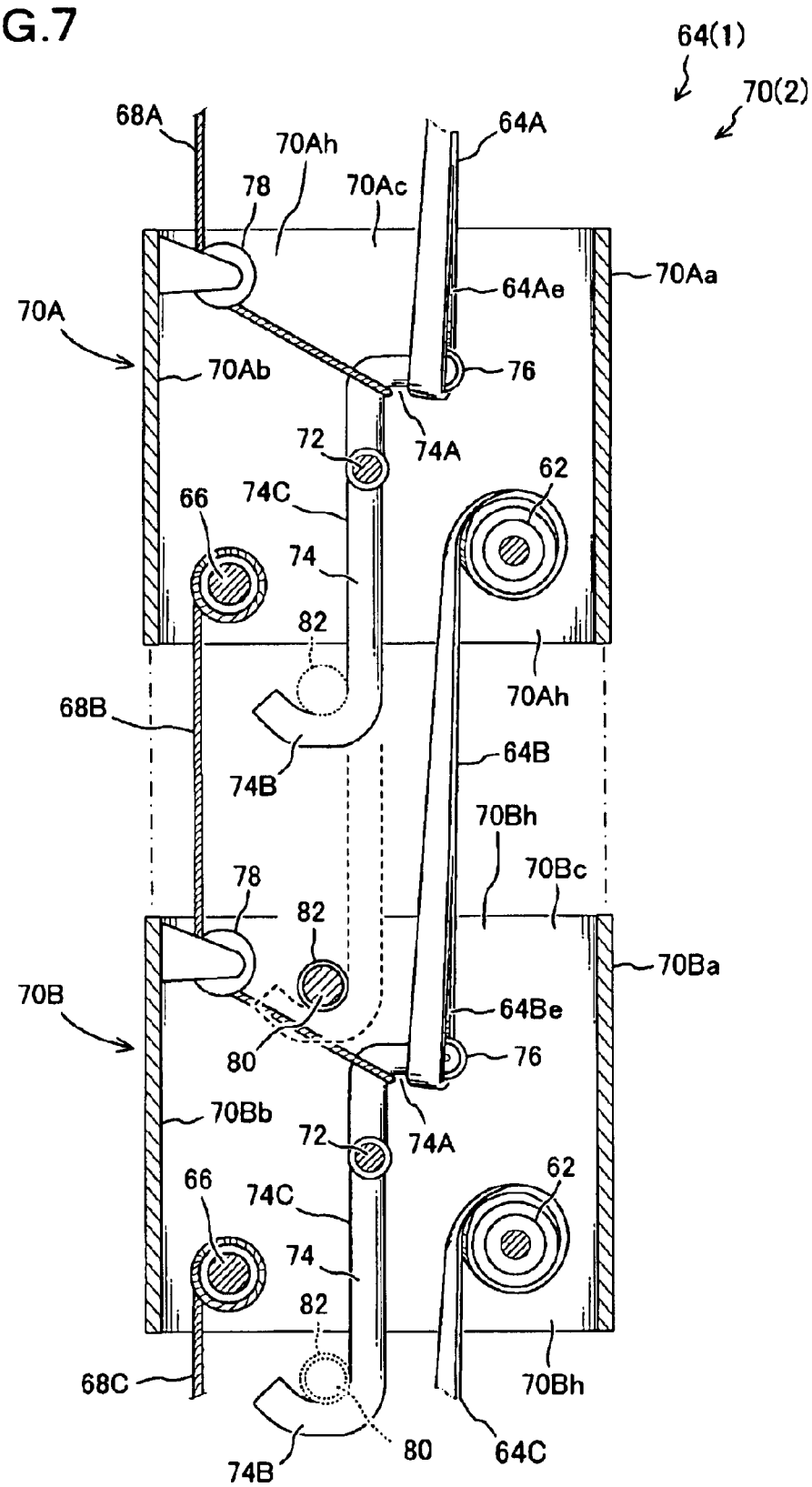
FIG. 7 is a fragmentary sectional view illustrating the structure of the first and second carrier units shown in the FIG. 6.
Figure 8:
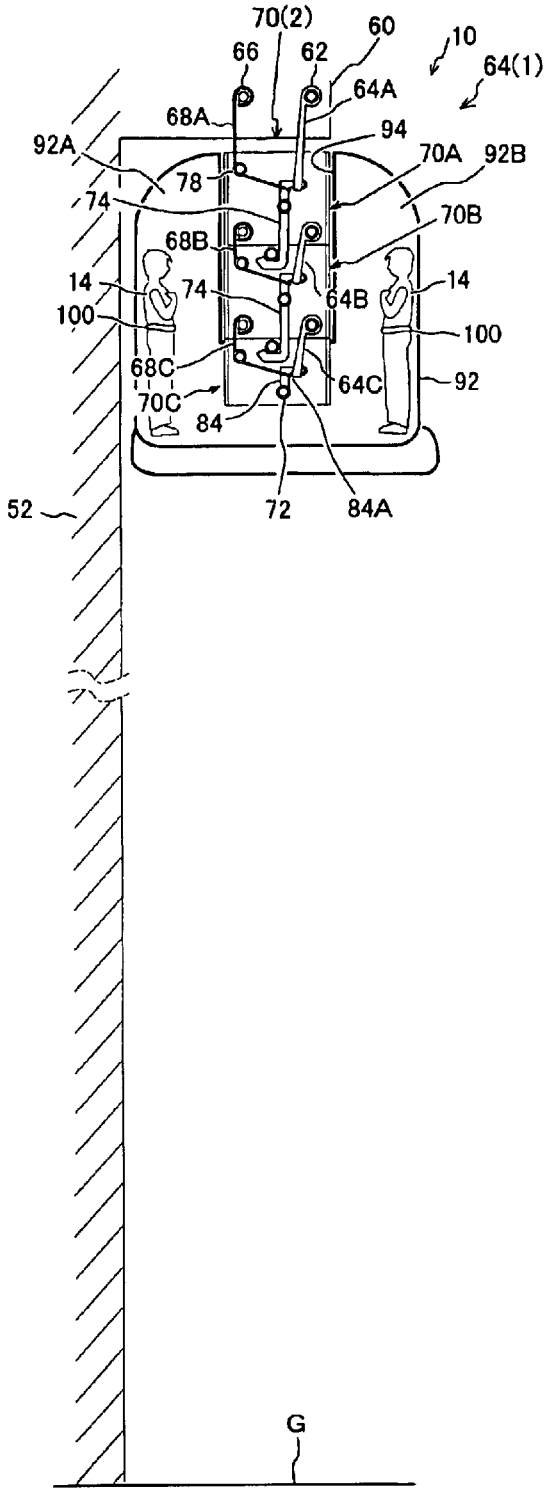
FIGS. 8(A) and 8(B) are diagrams illustrating a fourth alternative embodiment of escape device, which explanatorily show how it is disposed and used for escape purpose.
Figure 8:
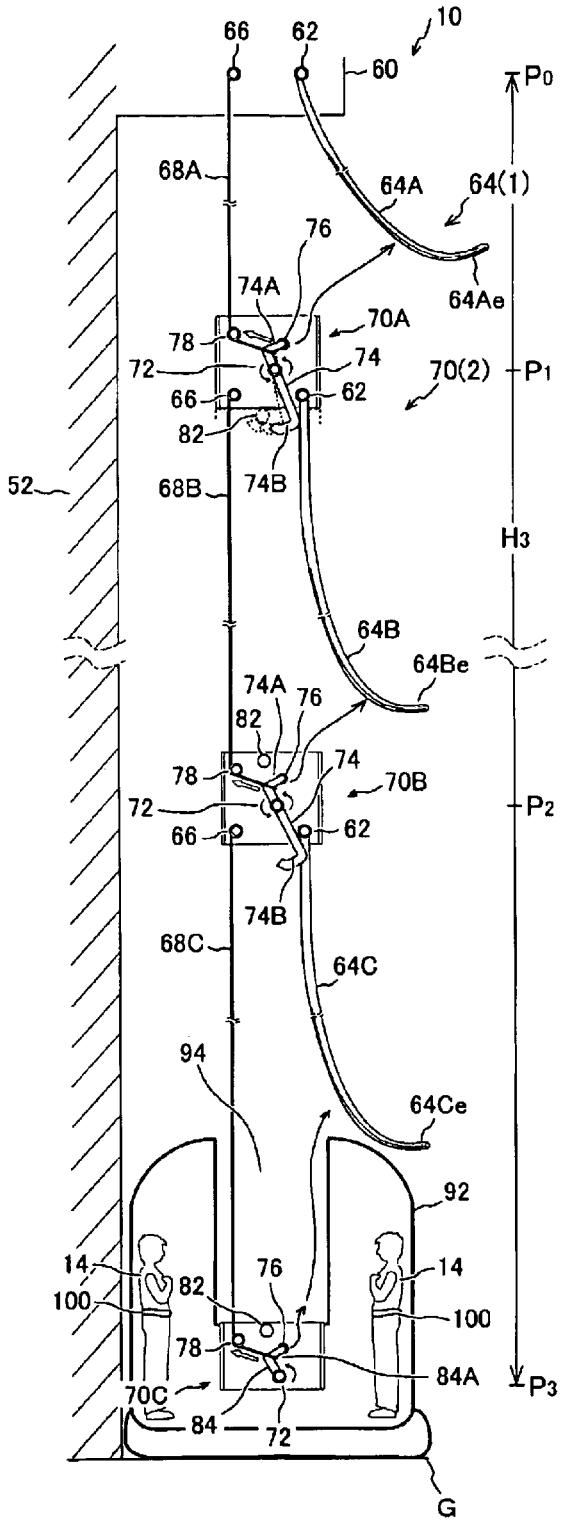

To avoid such problem, the escape device 10 may include a plurality of carrier means (1) to constitute a multistage carrier arrangement, instead of the one-stage carrier arrangement of the first and second embodiments. FIGS. 5(A) and 5(B) show how the multistage mode of escape device 10 is arranged at a high-rise building or skyscraper and an escaper 14 has to use such device and descend to a landing point P3. FIG. 6 shows a part of plural carrier units forming a principal part of the present invention. FIG. 7 is a sectional view taken along the line VII—VII in the FIG. 6.

As far as the present embodiment is concerned, as shown in FIGS. 5(A) and 5(B), the illustrated escape device 10 is of a three-stage carrier type having a three-stage carrier unit arrangement generally designated by 70. According thereto, there are provided a first carrier unit 70A, a second carrier unit 70B, and a third carrier unit 70C. Also, there are provided three rubber ropes (a first rubber rope 64A, a second rubber rope 64B and a third rubber rope 65C) as the elastic or bungee cord means (1); three carrier units (a first carrier unit 70A, a second carrier unit 70B and a third carrier unit 70C) as the carrier means (2); three auxiliary ropes (a first auxiliary rope 68A, a second auxiliary rope 68B, and a third auxiliary rope 68C); and a support container unit 60.

Referring to FIGS. 6 and 7, the first and second carrier units 70A and 70B are shown. The first carrier unit 70A is of a generally cubic configuration having a forward wall 70Aa; a backward wall 70Ab; a pair of lateral walls 70Ac; and upper and lower opened sides 70Ah, 70Ah. In the first carrier unit 70A, there are a generally S-shaped arm 74 rotatably journalled via a support shaft 72 between the two lateral walls 70Ac, and also, a pulley 78 is rotatably supported by a bracket 78A fixed on the backward wall 70Ab. As shown, the generally S-shaped arm 74 has a vertical body portion 74C, a horizontal upper portion 74A and a hook-like lower portion 74B. The vertical body portion 74C is integrally connected with the support shaft 72 whose two ends are respectively rotatably connected with the two lateral walls 70Ac in such a manner that the horizontal upper portion 74A is located within the body of carrier unit 70A, while the hook-like lower potion 74B projects outwardly and downwardly from the lower opened side 70Ah of the carrier unit 70A. Designation 76 denotes a small wheel rotatably provided in the distal end of the horizontal upper portion 74A. A first shaft 62 and a second shaft 66 are rotatably connected between the two lateral walls 70Ac, such that the former 62 is disposed forwardly of the shaft 72 on which is fixedly mounted the arm 74, and the latter 66 disposed rearwardly of the shaft 72, as illustrated.

The support container unit 60 is substantially similar to the one 20 described in the first and second embodiments and is fixedly attached to the wall of the high-rise building or skyscraper 52 at a point adjacent to or immediately above the windows. Within the container unit 60, there are extended a first shaft 62 and a second shaft 66 in a rotatable manner. As shown, the first rubber rope 64A is wound about the first shaft 62, with the looped end 64Ae thereof extending downwardly therefrom, and the first auxiliary rope 68A is wound about the second shaft 66, with a free remnant portion thereof extending downwardly therefrom. As best seen in FIG. 7, the downwardly and rectilinearly extending end portion of first auxiliary rope 68A is engaged partway about the pulley 78 and bent therefrom toward the arm 74, terminating in an end which is firmly secured to the bent portion of arm 74 between the horizontal and vertical portions 74A, 74C. The first rubber rope 64A is attached at its looped end 64Ae about the horizontal portion 74A of the arm 74, such that the distal end of that looped end 64Ae is partway in contact with the wheel 76.

The second carrier unit 70B is basically identical in structure to the above-described first carrier unit 70A, using the same parts and elements as those of the latter (70A), only except that an engagement rod 80 is connected firmly between the two lateral walls 70Bc at a point above the generally S-shaped arm 74. Hence, all like designations to be used in that second carrier unit 70B correspond to all like designations given in the first carrier unit 70A, and no further explanation will be made as to the common parts and elements between the first and second carrier units 70A, 70B.

In the second carrier unit 70B, the engagement rod 80 is disposed at a point on the circumference of a circle having a center at the axis of the shaft 72 associated with the first carrier unit 70A (i.e. a center of rotation of the generally S-shaped arm 74 associated with the first carrier unit 70A), as understandable from FIG. 7. As illustrated, a wheel 82 is rotatably attached about the engagement rod 80. The hook-like lower portion 74B of the arm 74 of the first carrier unit 70A is engaged with such wheel 82 so as to permit easy disengagement of that particular hook-like lower portion 74B from the engagement rod 80.

As shown in FIGS. 6 and 7, in the second carrier unit 70B, the second rubber rope 64B is wound about the first shaft 62, with the looped end 64Be thereof extending downwardly therefrom, whereas the second auxiliary rope 68B is wound about the second shaft 66, with a free remnant portion thereof extending downwardly therefrom. The second rubber rope 64B is attached at its looped end 64Be about the horizontal portion 74A of arm 74 such that the distal end of that looped end 64Be is partway in contact with the wheel 76. As best seen in FIG. 7, the downwardly and rectilinearly extending end portion of first auxiliary rope 68A is engaged partway about the pulley 78 and bent therefrom toward the arm 74 associated with the second carrier unit 70B, terminating in an end which is firmly secured to the bent portion of arm 74 between the horizontal and vertical portions 74A, 74C. The first rubber rope 64A is attached at its looped end 64Ae about the horizontal portion 74A of the arm 74, such that the distal end of that looped end 64Ae is partway in contact with the wheel 76.

The third carrier unit 70C is basically of a similar structure to that of the second carrier unit 70B, except for the following points: (i) the aforementioned first and second shafts 62, 66 are no longer provided since the third carrier unit 70C is a final stage unit, (ii) a generally inverted-L-shaped arm 84 having a horizontal upper portion 84A and a wheel 76 rotatably provided in the distal end of that upper portion 84A is provided, instead of the S-shaped arm 74, since there is no need to couple any additional carrier unit with the last unit 70C, and (iii) a pair of shoulder straps 86 (similar to the shoulder straps 31 in the first embodiment) are fixedly attached to the forward wall 70Ca of the unit 70C, so that an escaper 14 can bear that carrier unit 70C on his or her back with the shoulder straps 86. Only apart from those pints, the third carrier unit 70C uses the same parts and elements as those of the second carrier unit 70B as understandable from FIGS. 5(A) and 5(B). Thus, all like designations to be used in that second carrier unit 70B correspond to all like designations given in the first carrier unit 70A, and no further explanation will be made as to the common parts and elements between the second and third carrier units 70B and 70C.

As indicated in FIG. 5(B), in a given large height H3, there are defined three stages at which the three rubber ropes 64A, 64B and 64C will be disengaged from their respective carrier units 70A, 70B and 70C in order from a first disengagement point P1 to a fixed landing point P3.

Namely, a first disengagement stage is defined from the given high position P0 to a first disengagement point P1, and as such, a workable length of the first rubber rope 64A is preset such that it will be resiliently stretchable to a maximum length with respect to a certain weight of an escaper 14 from the position P0 to the first disengagement point P1, whereas an operative length of the first auxiliary rope 68A is substantially equal to a distance from the position P0 to the first disengagement point P1, so that the first auxiliary rope 68A will drop and run downwardly from the second shaft 66 in the support container unit 60 (i.e. at the high point P0) to the extent that the rope 68A finishes such downward falling at the first disengagement point P1 so as to draw and rotate the arm 74 in the first carrier unit 70A in anticlockwise direction. A second disengagement stage is defined from the first disengagement point P1 to a second disengagement point P2. Thus, a workable length of the second rubber rope 64B is such that it will be resiliently stretchable to a maximum length with respect to a certain weight of an escaper 14 from the first disengagement point P1 to the second disengagement point P2. Also, an operative length of the second auxiliary rope 68B is substantially equal to a distance between the first and second disengagement points P1 and P2 so that the second auxiliary rope 68B will A drop and run downwardly from the second shaft 66 in the first carrier unit 70A (at the first disengagement point P1) to the extent that the rope 68B finishes such downward falling at the second disengagement point P2 so as to draw and rotate the arm 74 in the second carrier unit 70B in anticlockwise direction. A third disengagement stage is defined from the second disengagement point P2 to a third disengagement point P3. Hence, a workable length of the third rubber rope 64C is such that it will be resiliently stretchable to a maximum length with respect to a certain weight of an escaper 14 from the second disengagement point P2 to the third disengagement point P3. Also, an operative length of the third auxiliary rope 68C is substantially equal to a distance between the second and third disengagement points P2, P3 so that the third auxiliary rope 68C will drop and run downwardly from the second shaft 66 in the second carrier unit 70B (at the third disengagement point P3) to the extent that the rope 68C finishes such downward falling at the third disengagement point P3 so as to draw and rotate the arm 84 in the third carrier unit 70C in anticlockwise direction.

Now, an explanation will be made about how to use the present third mode of escape device. When an escaper 14 in the building 52 attempts to escape therefrom, he or she has to bear the third carrier unit 70C on his or her back, using the shoulder straps 86, and fall down from the window of the building 52 as in FIG. 5(A). Then, at first, both first rubber and auxiliary ropes 64A, 68A are drawn and run downwardly from their respective first and second rotatable shafts 62, 66 in the support container unit 60. A whole length of the first rubber rope 64A is rolled out and suspended from the first shaft 62 at a given point near to the first disengagement point P1. Then, the first rubber rope 64A is subjected to elastic further stretching and extension due to its elasticity to resist and reduce a first accelerated velocity at which the escaper 14 is descending under the gravity from the point P0. As the first rubber rope 64A is resiliently stretched to a maximum degree, the first auxiliary rope 68A is extended to its preset whole length, with the result that the first carrier unit 70A is stopped at the first disengagement point P1 and the downward end portion of the auxiliary rope 68A is pulled upwardly via the pulley 78, thereby rotating the S-shaped arm 74 about the shaft 72 in the anticlockwise arrow direction and the arm 74 is inclined by such an angle that causes the arm horizontal portion 74A to displace from a horizontal position, at which the looped end 64Ae of rubber rope 64A is attached thereto, to an upwardly inclined position as shown. That looped end 64Ae is then quickly slid and disengaged from the thus-inclined arm horizontal portion 74A, whereupon the first rubber rope 64A is disengaged from the first carrier unit 70A, thus preventing the second and third carrier units 70B, 70C from being pulled upwardly due to the elastic contraction of first rubber rope 64A. At the same time, with the anticlockwise rotation of the arm 74, the hook-like lower portion 74B is displaced in the same anticlockwise direction and disengaged from the engagement rod 82 of the second carrier unit 70B. Accordingly, the second carrier unit 70B is separated and fallen from the thus-stopped first carrier unit 70A, while both second rubber and auxiliary ropes 64B, 68B are being drawn and run downwardly from their respective first and second shafts 62, 66 of the first carrier unit 70A. Then, when a whole length of the second rubber rope 64B is rolled out and suspended from the first shaft 62 at a given point near to the second disengagement point P2, the second rubber rope 64B per se is subjected to elastic further stretching and extension due to its elasticity, thereby resisting and reducing a second accelerated velocity at which the escaper 14 is descending under the gravity from the first carrier unit 70A. Then, when the second rubber rope 64B is resiliently stretched to a maximum degree, the second auxiliary rope 68B is extended to its preset whole length. Eventually, the second carrier unit 70B is stopped at the second disengagement point P2 and the downward end portion of the second auxiliary rope 68B is pulled upwardly via the pulley 78, thereby rotating the S-shaped arm 74 about the shaft 72 in the anticlockwise arrow direction. That arm 74 is therefore inclined by such an angle that causes the arm horizontal portion 74A to displace from a horizontal position, at which the looped end 64Be of second rubber rope 64B is attached thereto, to an upwardly inclined position as shown. The looped end 64Be is then quickly slid and disengaged from the thus-inclined arm horizontal portion 74A, whereupon the second rubber rope 64B is quickly disengaged from the second carrier unit 70B, thus preventing the third carrier unit 70C and escaper 14 from being pulled upwardly due to the elastic contraction of second rubber rope 64B. At the same time, with such anticlockwise rotation of the arm 74, the hook-like lower portion 74B is displaced in the same anticlockwise direction and disengaged from the engagement rod 82 of the third carrier unit 70C. Accordingly, the third carrier unit 70C is separated and fallen from the thus-stopped second carrier unit 70B, while both third rubber and auxiliary ropes 64C, 68C are being drawn and run downwardly from their respective first and second shafts 62, 66 of the second carrier unit 70B. Then, when a whole length of the third rubber rope 64C is rolled out and suspended from the first shaft 62 at a given point near to the third disengagement point P3, the third rubber rope 64C per se is subjected to elastic further stretching and extension due to its elasticity, thereby resisting and reducing a third final accelerated velocity at which the escaper 14 is descending under the gravity from the second carrier unit 70B. Then, when the third rubber rope 64C is resiliently stretched to a maximum degree, the third auxiliary rope 68C is extended to its preset whole length. Eventually, the third carrier unit 70C is stopped at the third disengagement point P3 and the downward end portion of the third auxiliary rope 68C is pulled upwardly via the pulley 78, thereby rotating the inverted-L-shaped arm 84 about the shaft 72 in the anticlockwise arrow direction. That arm 84 is therefore inclined by such an angle that causes the arm horizontal portion 84A to displace from a horizontal position, at which the looped end 64Ce of third rubber rope 64C is attached thereto, to an upwardly inclined position as shown. That looped end 64Ce is then quickly slid and disengaged from the thus-inclined arm horizontal portion 84A, thereby preventing the escaper 14 from being pulled upwardly due to the elastic contraction of third rubber rope 64C. Therefore, the escaper 14 softly and positively lands on the ground G, as in FIG. 5(B). Likewise as in the first and second embodiments, the escaper 14, who is relatively light in weight and insufficient to overcome an elastic pullback force of the third rubber rope 64C, may attach the weight belt 100 to his or her body so that both escaper 14 and third carrier unit 70C can reach the landing point P3 without being pulled back upwardly before landing on the ground G. Accordingly, the escaper 14 can take off the third carrier unit 70C and leave from the building 52 to a safe place.

With the present mode of escape device 10, it is appreciated that the escaper 14 is descended at three stages down to the ground G via the three carrier units 70A, 70B and 70C, thereby effectively reducing an accelerated descending velocity of the escaper 14 to prevent a damage to his or her body when landing on the ground G.

Embodiment 4

Reference is now made to FIGS. 8(A) and 8(B). There is illustrated an alternative fourth embodiment of escape device 10 which is basically identical in structure, actions and effects to the above-described third embodiment, only except that the device includes a gondola 92 as one of the carrier means (2) instead of the shoulder straps 86 of the third embodiment so as to enable a plurality of escapers 14 to be accommodated in the gondola and be descended to the ground G. As similar to the third embodiment, there is employed an escape device of multistage type; namely, a three-stage carrier unit arrangement 70 is provided in the shown embodiment, which comprises three carrier units 70A, 70B and 70C. Therefore, all like designations to be used hereinafter correspond to all like designations given in the third embodiment, and no further explanation will be made as to the common parts and elements between the third and fourth embodiments.

As can be seen from FIGS. 8(A) and 8(B), the illustrated gondola 92 is of such a configuration that circumscribes the four walls of the three carrier units 70A, 70B and 70C which are in the state of being coupled together and adapted to allow two escapers 14 to be accommodated therein. More specifically, the gondola 92 is formed with a recession 94 centrally thereof, and further has, defined therein, a pair of rooms 92A and 92B for accommodating two escapers 14, respectively. In that recession 94, those three carrier units 70A, 70B and 70C are stored in such a manner that only the third carrier unit 70C is fixedly attached to the lower region of such recession 94. Of course, the three carrier units 70A, 70B and 70C may be formed in a suitable size and robust structure for that gondola 92, and the three rubber ropes 64A, 64B and 64C as well as the three auxiliary ropes 68A, 68B and 68C may be of a strength enough to withstand a total weight of the gondola 92, plural escapers 14 and three carrier units 70A, 70B and 70C.

The operation and use of this particular mode of escape device are exactly the same as those of the above-describe third embodiment. Thus, any further specific description is omitted thereon for the sake of simplicity. FIG. 8(A) shows a state where the gondola 92 and coupled three carrier units 70A, 70B and 70C are about to be descended from the support container unit 60, wherein two escapers 14 stand in the gondola 92. In brief, as shown in FIG. 8(B), the first, second rubber and third rubber ropes 64A, 64B and 64C are disengaged in sequence from the respective first, second and third carrier units 70A, 70B and 70C, while the first, second and third auxiliary ropes 68A, 68B and 68C terminate their respective downward falling in sequence so that the first and second carrier units 70A and 70B are stopped in order at the first and second disengagement points P1, P2, respectively and, finally, the third carrier unit 70C reaches the landing point P3. In that way, the gondola 92 softly lands on the ground G, without being pulled upwardly due to the elastic contraction of third rubber rope 64C. Of course, likewise as in all of the foregoing embodiments, the escaper 14, who is relatively light in weight and insufficient to overcome an elastic pullback force of the third rubber rope 64C, may attach the weight belt 100 to his or her body so that both escaper 14 and gondola 92 can reach the landing point P3 without being pulled back upwardly by the elastic contraction force of third rubber rope 70C before landing on the ground G. Accordingly, the escapers 14 can get out of the gondola 92 and leave from the building 52 to a safe place. It is also appreciated that the escapers 14, who are in the gondola 92, are free of exposure to an outside air and do not feel a fear of the high descending velocity. In this regard, the gondola 92 itself may be formed from an opaque material in such a manner as to block vision of the escapers 14 from a scene outside the gondola so that they will not suffer from a dread of heights psychologically.

Finally, it should be understood that the present invention is not limited to the illustrated embodiments, but any other modification, replacement and addition may be applied thereto without departing from the scopes of the appended claims. For instance, the present invention may be modified in the following manners:

(1) To make reusable both rubber and auxiliary ropes, there may be provided a manual arrangement to manually draw and store those two ropes into the support container unit, or a suitable rope rewinding device may be incorporated in the support container unit so that those ropes may be rewound and stored thereinto with ease. Further, since the elastic stretchable degree of the rubber rope varies, depending on the weight of escaper, a length adjustment means may be provided to the rubber rope in order that the escaper may adjust the length of the rubber rope to a proper stretchable degree according to his or her own weight.

(2) While the arm(s) (34, 74) and auxiliary rope(s) are utilized as above, any other known mechanism and means may be employed to cause disengagement of the rubber rope(s) from the carrier unit(s). Also, any suitable means equivalent to the grab bar 42 may be used to enable an escaper to easily grab it in a secure manner.

(3) The third embodiment described above suggests using three-stage carrier arrangement or three carrier units (70A, 70B and 70C), but, instead thereof, two carrier units may be used, or a desired number of carrier units be used, depending on the height of the high-rise building or skyscraper.

(4) The fourth embodiment described above suggests using a gondola 92 adapted to accommodate two escapers therein, but the gondola may be formed to accommodate a desired number of escapers therein. Of course, the gondola be designed to accommodate only one escapers therein. Further, suitable belts and handrails may be equipped with the inside of those gondolas so that the escaper can secure his or her body thereto.

(5) All the embodiments of the present invention are based on a rescue from buildings and plants, but they may be used to carrier or descend articles or goods from a high location to a low location. The landing point described above may be a terrace or deck of the building.

From the descriptions made so far, it is appreciated that the escape device in accordance with the present invention features using bungee cord(s) or rubber rope(s) to resist and reduce an accelerated velocity at which an escaper descends under the gravity, and realizing a properly timed disengagement of rubber rope(s) from the carrier unit(s), thereby enabling the escaper to descend from a high position to low position in a comfortable manner and softly land on the ground for quick evacuation to a safe place. Such escape device may not only be applied to a low-rise building, but also be applied to mid-rise building or skyscraper which makes it difficult for helicopter and ladder-style fire engine to gain access thereto.

What is claimed is:

1. An escape device for allowing at least one person to escape from a high position to a predetermined landing point, comprising:

an elastic cord means having a length and an elastic property of being stretchable from the length to a maximum length substantially at said landing point, said elastic cord means having a free end;

a container means so designed that said elastic cord means is supportively stored while being allowed to be pulled out therefrom, said container means being provided at said high position;

a carrier means connected with said free end of said elastic cord means, said carrier means being so designed to permit said at least one person to hold the carrier or secure his or her body thereto and descend therewith via said elastic cord means from said high position to said predetermined landing point;

wherein an auxiliary rope means is provided, which has a free end and is of a whole length substantially equal to a distance between said high position and said predetermined landing point, said auxiliary rope means being supportively stored in said container means while being allowed to be pulled out therefrom;

wherein said carrier means is releasably connected with said free end of said elastic means; and wherein a disengagement means is provided, which is connected with said free end of said auxiliary rope means, said disengagement means being operable to disengage the free end of said elastic cord means from said carrier means when the carrier means reaches said predetermined landing point while at the same time said auxiliary cord means is pulled out and extended to the whole length thereof.

2. The escape device according to claim 1, wherein said carrier means comprises a backpack-type carrier unit having a shoulder strap means, said backpack-type carrier unit being of such a structure that permits said at least one person to bear on his or her back with said shoulder strap means.

3. The escape device according to claim 1, wherein said disengagement means comprises an inverted-L-shaped arm rotatably provided in said carrier means, said inverted-L-shaped arm having an end portion, wherein said free end of said auxiliary cord means is fixedly attached to said inverted-L-shaped arm, whereas said free end of said elastic cord means is releasably attached to said end portion of the inverted-L-shaped arm, so that, upon said auxiliary cord means being pulled out and extended to the whole length thereof when said carrier means reaches said predetermined landing point, said inverted-L-shaped arm is caused to rotate by such an angle that allows for disengagement of said free end of said elastic cord means therefrom, whereby the elastic cord means is disengaged from said carrier means.

4. The escape device according to claim 1, which includes a weight means capable of being detachably secured to said at least one person who is relatively light in weight and insufficient to overcome an elastic pullback force of said elastic cord means, thereby allowing both said at least one person and said carrier means to reach said predetermined landing point.

5. An escape device for allowing at least one person to escape from a high position to a predetermined landing point, comprising:

an elastic cord means having a length and an elastic property of being stretchable from the length to a maximum length substantially at said landing point, said elastic cord means having a free end;

a container means so designed that said elastic cord means is supportively stored while being allowed to be pulled out therefrom, said container means being provided at said high position;

a carrier means connected with said free end of said elastic cord means, said carrier means being so designed to permit said at least one person to hold the carrier or secure his or her body thereto and descend therewith via said elastic cord means from said high position to said predetermined landing point;

wherein a first carrier means and a second carrier means are provided as said carrier means, wherein said second carrier means is so designed to allow said at least one person to secure his or her body thereto, wherein, as said elastic cord means, a first elastic cord means is arranged between said container unit and said first carrier means and a second elastic cord means is arranged between said first and second carrier means, wherein an auxiliary rope means is provided, which includes: a first auxiliary rope means arranged between said container unit and said first carrier means; and a second auxiliary rope means arranged between said first and second carrier means, wherein a first disengagement means is provided in said first carrier means such that the first disengagement means is actuated to disengage said first elastic cord means from said first carrier means when the first carrier means reaches a predetermined point between said high position and said landing point while at the same time said first auxiliary cord means is pulled out and extended to a whole length thereof, and wherein a second disengagement means is provided in said second carrier means such that the second disengagement means is actuated to disengage said second elastic cord means from said second carrier means when the second carrier means reaches said landing point while at the same time said second auxiliary cord means is pulled out and extended to a whole length thereof.

6. The escape device according to claim 5, wherein said first carrier means comprises a plurality of carrier units including a last carrier unit, wherein said first elastic cord means comprises a plurality of rubber ropes arranged among said plurality of carrier units, said plurality of rubber ropes including a last rubber rope, wherein said second elastic cord means comprises a rubber rope arranged between said last carrier unit of said plurality of carrier units and said second carrier means, wherein said first auxiliary rope means comprises a plurality of auxiliary ropes arranged among said plurality of carrier units, and wherein said second auxiliary rope means comprises an auxiliary rope arranged between said last carrier unit of said plurality of carrier units and said second carrier means.

7. The escape device as claimed in claim 5, wherein said first auxiliary rope means has a free end, wherein the whole length of said first auxiliary rope means is substantially equal to a distance between said high position and said predetermined engagement point, wherein said first auxiliary rope means is supportively stored in said container means while being allowed to be pulled out therefrom, wherein said second auxiliary rope means has a free end, wherein the whole length of said second auxiliary rope means is substantially equal to a distance between said second carrier means and said predetermined landing point, wherein said second auxiliary rope means is supportively stored in said first carrier means while being allowed to be pulled out therefrom, wherein said first carrier means is releasably connected with said free end of said first elastic cord means, while said second carrier means is releasably connected with said free end of said second elastic cord means, wherein said first disengagement means is connected with said free end of said first auxiliary rope means such that said first disengagement means is actuated to disengage the free end of said first elastic cord means from said first carrier means when said first auxiliary cord means is pulled out to said whole length thereof and said first carrier means reaches said predetermined point; and wherein said second disengagement means is connected with said free end of said second auxiliary rope means such that said second disengagement means is actuated to disengage the free end of said second elastic cord means from said second carrier means when said second auxiliary cord means is pulled out to said whole length thereof and said second carrier means reaches said landing point.

8. The escape device as claimed in claim 5, wherein said first disengagement means comprises at least one generally S-shaped arm rotatably provided in said first carrier means, wherein said second disengagement means comprises a generally inverted-L-shaped arm rotatably provided in said second carrier means, wherein said first and second auxiliary cord means are fixedly connected with said at least one generally S-shaped arm and said generally inverted-L-shaped arm, respectively, while said first and second elastic cord means are, at the respective free ends thereof, releasably attached to said at least one generally S-shaped arm and said generally inverted-L-shaped arm, respectively, with such an arrangement that, when said first auxiliary cord means is extended to the whole length thereof and said first carrier means reaches said predetermined point, said at least one generally S-shaped arm is rotated to cause disengagement of said first elastic cord means therefrom, and then, when said second auxiliary cord means is extended to the whole length thereof and said second carrier means reaches said landing point, said generally inverted-L-shaped arm is rotated to cause disengagement of said second elastic cord means therefrom.

9. The escape device as claimed in claim 5, wherein said second carrier means comprises a backpack-type carrier unit having a shoulder strap means, said backpack-type carrier unit being of such a structure that permits said person to bear on his or her back with said shoulder strap means.

10. The escape device as claimed in claim 5, wherein a gondola is provided on said first and second carrier means so as to accommodate at least two persons therein.

11. The escape device according to claim 5, which includes a weight means capable of being detachably secured to said person who is relatively light in weight and insufficient to overcome an elastic pullback force of each of said first and second elastic cord means, thereby allowing both said person and said second carrier means to reach said predetermined landing point.

* * * * *